US007341310B1

(12) United States Patent
Ross

(10) Patent No.: US 7,341,310 B1
(45) Date of Patent: Mar. 11, 2008

(54) OFFICE CHAIR WITH AUTOMATED HEIGHT ADJUSTMENT

(76) Inventor: Betty Ross, 3830 Verde Bosque St., San Antonio, TX (US) 78223

( * ) Notice: Subject to any disclaimer, the term of this patent is extended or adjusted under 35 U.S.C. 154(b) by 0 days.

(21) Appl. No.: 11/474,647

(22) Filed: Jun. 26, 2006

Related U.S. Application Data

(60) Provisional application No. 60/693,619, filed on Jun. 24, 2005.

(51) Int. Cl.
*A47C 1/00* (2006.01)

(52) U.S. Cl. ..... 297/344.17; 297/344.12

(58) Field of Classification Search ..... 297/344.12, 297/344.16, 344.17, DIG. 10
See application file for complete search history.

(56) References Cited

U.S. PATENT DOCUMENTS

| | | | | | |
|---|---|---|---|---|---|
| 2,982,336 | A | * | 5/1961 | Minici | 248/421 |
| 3,144,270 | A | * | 8/1964 | Bilancia | 297/180.16 |
| 4,231,614 | A | * | 11/1980 | Shaffer | 297/330 |
| 4,685,731 | A | * | 8/1987 | Migut | 297/344.17 |
| 4,838,612 | A | * | 6/1989 | Cross | 297/338 |
| 5,251,864 | A | * | 10/1993 | Itou | 248/588 |
| 5,556,163 | A | * | 9/1996 | Rogers et al. | 297/330 |
| 5,695,248 | A | * | 12/1997 | Bell | 297/344.17 |
| 6,113,188 | A | * | 9/2000 | Stewart et al. | 297/339 |

* cited by examiner

*Primary Examiner*—Joe Edell
(74) *Attorney, Agent, or Firm*—Kenneth L. Tolar

(57) ABSTRACT

An office chair includes a base structure having a pan mounted thereon. A motor driven scissor lift is positioned on the pan that expands and contracts to raise and lower a chair member. A pair of buttons control the motor allowing a user to automatically raise and lower the chair member to a desired height.

3 Claims, 2 Drawing Sheets

OFFICE CHAIR WITH AUTOMATED HEIGHT ADJUSTMENT

CROSS REFERENCE TO RELATED APPLICATIONS

This application is entitled to the benefit of provisional application No. 60/693,619 filed on Jun. 24, 2005, the specification of which is incorporated herein by reference.

BACKGROUND OF THE INVENTION

The present invention relates to an office chair having an automated height adjustment.

DESCRIPTION OF THE PRIOR ART

Though height adjustable office chairs exist in the prior art, most are only adjustable within a minimal range so as to accommodate varying size users. The most common adjustment mechanism is a screw shaft assembly whereby the seat is gradually raised or lowered by rotating it in a predetermined direction; adjusting the screw shaft assembly is not only laborious and time consuming, but is usually not an option for temporary adjustments when accessing low level file drawers or performing similar tasks. Pneumatic lifting mechanisms also exist that are less laborious, but they have a limited range. Accordingly, there is currently a need for a chair in which the height of the seat can be temporarily adjusted within a substantially wide range. The present invention addresses this need by providing a uniquely designed office chair having a motorized scissor lift that allows a user to automatically adjust the height thereof.

SUMMARY OF THE INVENTION

The present invention relates to an office chair including a base structure having a pan mounted thereon. A motor driven scissor lift is positioned on the pan that expands and contracts to raise and lower a chair member. A pair of buttons control the motor allowing a user to automatically raise and lower the chair member to a desired height.

It is therefore an object of the present invention to provide an office chair having an automated lifting means.

It is another object of the present invention to provide an office chair that can be raised and lowered within a wide range.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
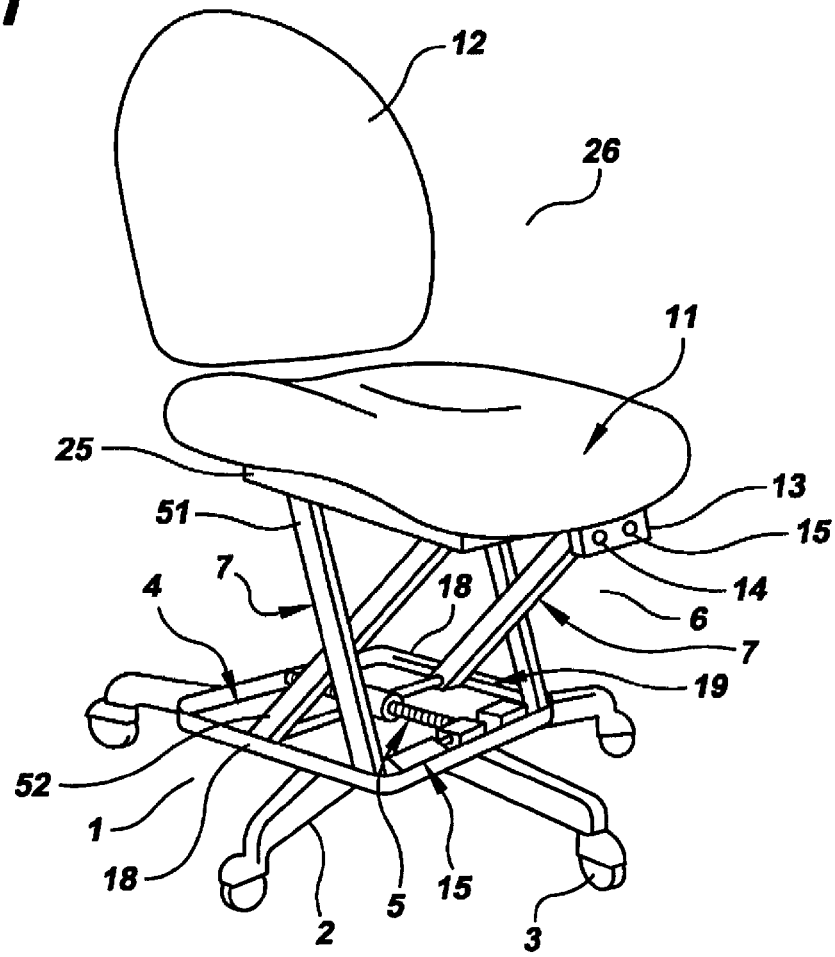
FIG. 1 is a perspective view of the chair according to the present invention.
Figure 2:
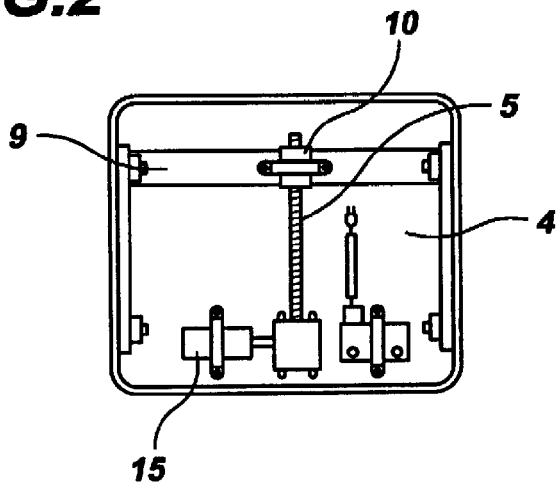
FIG. 2 is a top view of the drive screw assembly and pan according to the present invention.
Figure 3:
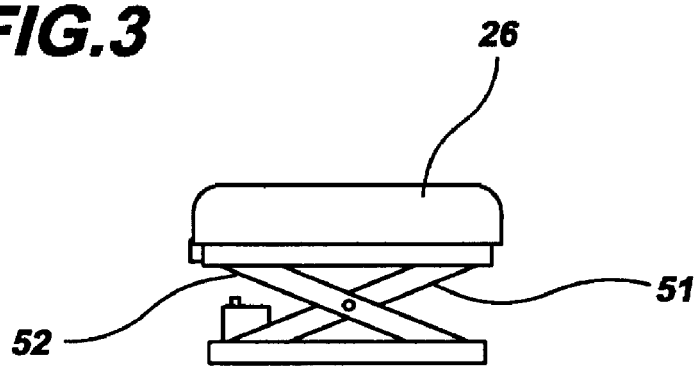
FIG. 3 is a side view of the chair in a collapsed configuration.
Figure 4:
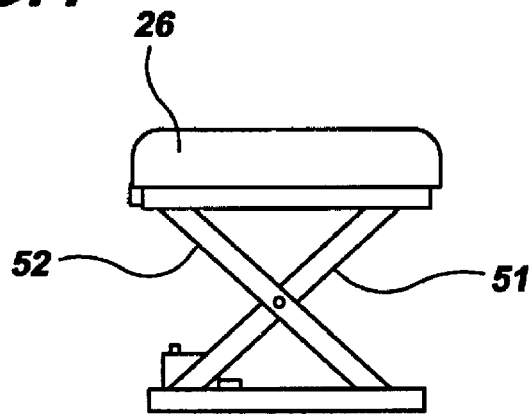
FIG. 4 is a side view of the chair in a raised configuration.
Figure 5:
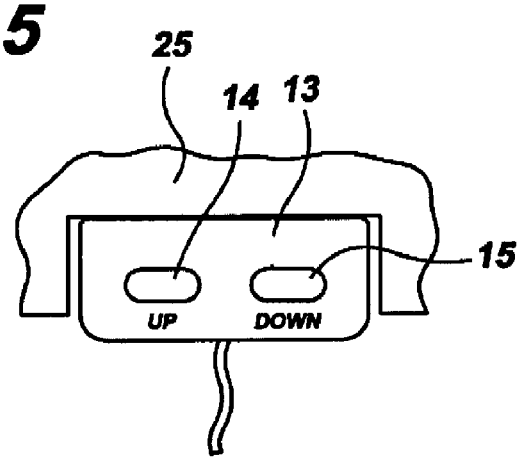
FIG. 5 depicts the control panel for controlling the motor.

The present invention relates to an office chair having an automated height adjustment assembly. The device comprises a base structure 1 including a plurality of support legs 2 radially extending from a central hub. Each of the legs has a caster 3 at a distal end allowing the chair to roll about an underlying support surface. Mounted on the base structure is a lower pan 4 having a motor 15 positioned thereon that operates an externally threaded drive screw 5. Extending upwardly from the pan is a scissor lift 6 having two opposing scissor frames 7, each formed of first 51 and second 52 arms that are pivotally joined at their intermediate portions. The lower ends of the first arms 51 are pivotally attached to a front end of the pan. The lower ends of the second arms 52 are pivotally connected to a drive shaft 9. The shaft includes an internally threaded, transverse sleeve 10 that threadedly receives the drive screw whereby rotation thereof results in axial translation of the sleeve to expand and contract the scissor lift in a conventional fashion. The lower ends of the second arms 52 each include an outwardly extending guide member that is slidably received within one of two oblique, upwardly sloped channels 19 formed on each of two opposing sidewalls 18 of the pan. A lid (not pictured) is superimposed on the lower pan to protect the motor, drive screw and associated elements.

The upper ends of both the first and second arms are fastened to a lower surface of a chair support pan 25 that has a cushioned chair member 26 mounted thereon; the chair member includes a seat portion 11 with a backrest portion 12 vertically extending therefrom. Depending from the chair support is a control panel 13 with a pair of buttons that control the operation and direction of the motor; a first button 14 expands the scissor lift to raise the height of the chair member while a second button 15 contracts the lift to lower the chair member. Accordingly, by depressing one of the buttons on the control panel, a user can automatically raise and lower the seat member to a desired height. The sloped channels assure that the seat portion remains on a horizontal plane as the scissor lift expands and contracts.

Preferably, the motor is powered with a rechargeable battery that is replenished with a smart charger mounted on the lower pan. An accompanying power cord provides 120 VAC to the charger.

The above described device is not limited to the exact details of construction and enumeration of parts provided herein. Furthermore, the size, shape and materials of construction can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. An office chair having an automated height-adjustment assembly comprising:

a base structure including a plurality of support legs radially extending from a central hub, said support legs each having a distal end with a caster thereon;

a pan mounted on the base structure;

a chair member superimposed onto said pan;

a scissor lift attached to said pan and said chair wherein said scissor lift includes two opposing scissor frames, each scissor frame formed of a first arm and a second arm, each of said arms having an upper end, a lower end and an intermediate portion, said first and second arms pivotally joined at the intermediate portions; said lower end of the first arm pivotally attached to said pan, the lower end of each scissor frame second arm including an outwardly extending guide member, said guide member slidably received within an oblique, upwardly sloped channel formed on one of two opposing sidewalls of the pan to assure that said chair member remains horizontal during expansion and contraction of said scissor lift;

a shaft interconnecting the lower ends of the second arms, said shaft having an internally threaded, transverse sleeve thereon;

a drive screw received within said sleeve;

a motor operably connected to said drive screw whereby operation of said motor results in rotation of said drive screw and axial translation of the sleeve to expand and contract the scissor lift to raise and lower the chair member.

2. The chair according to claim 1 further comprising a control panel attached to said chair for controlling said motor.

3. The chair according to claim 2 wherein said chair includes a seat portion with a backrest portion vertically extending therefrom.

* * * * *